US006121589A

United States Patent [19]

Tanaka

[11] Patent Number: 6,121,589

[45] **Date of Patent: *Sep. 19, 2000**

[54] HEATING DEVICE FOR SHEET MATERIAL

[75] Inventor: Hiroshi Tanaka, Kyoto, Japan

[73] Assignee: Rhom Co., Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/732,351

[22] PCT Filed: Mar. 25, 1996

[86] PCT No.: PCT/JP96/00787

§ 371 Date: Oct. 16, 1996

§ 102(e) Date: Oct. 16, 1996

[87] PCT Pub. No.: WO96/31089

PCT Pub. Date: Oct. 3, 1996

[30] Foreign Application Priority Data

Mar. 28, 1995 [JP] Japan ..... 7-069305

[51] Int. Cl.[7] ..... B65D 1/24; B65D 88/34

[52] U.S. Cl. ..... 219/543; 219/216

[58] Field of Search ..... 219/543, 541, 219/544, 216, 469; 346/76 PH; 399/328, 329, 330, 335; 347/202

[56] References Cited

U.S. PATENT DOCUMENTS

| | | | |
|---|---|---|---|
| 4,835,550 | 5/1989 | Sato et al. | 346/76 PH |
| 5,181,006 | 1/1993 | Shafe et al. | 338/22 R |
| 5,321,386 | 6/1994 | Ishiguro | 338/269 |
| 5,371,341 | 12/1994 | Ota et al. | 219/543 |
| 5,374,341 | 12/1994 | Ota | 219/543 |
| 5,408,574 | 4/1995 | Deevi et al. | 392/404 |
| 5,414,245 | 5/1995 | Hackleman | 219/548 |
| 5,560,851 | 10/1996 | Thimm et al. | 219/543 |
| 5,577,158 | 11/1996 | Kallgren et al. | 392/433 |
| 5,821,501 | 10/1998 | Zorn | 219/219 |

FOREIGN PATENT DOCUMENTS 0 546 495 A2 8/1992 European Pat. Off. .

*Primary Examiner*—Teresa Walberg
*Assistant Examiner*—Daniel Robinson
*Attorney, Agent, or Firm*—Merchant & Gould P.C.

[57] ABSTRACT

A heating device (1) according to the present invention includes a substrate (2) made of a heat-resistant insulating material, a heating resistor layer (3) formed on the substrate (2), and a protective layer (6) formed on the substrate (2) to cover the heating resistor layer (3). The protective layer (6) is formed of glass to which alumina powder having a grain size of no greater than 5 $\mu$m is added. The addition proportion of alumina powder is 3–30 Wt %, preferably 3–22 Wt % and particularly 10–22 Wt %. The addition of alumina powder remarkably increases the dielectric strength of the protective layer (6).

6 Claims, 2 Drawing Sheets

HEATING DEVICE FOR SHEET MATERIAL

TECHNICAL FIELD

The present invention relates to a heating device for heating a sheet material such as paper for a copying machine, a material sheet for a film laminating machine and the like.

BACKGROUND ART

Heating devices used for the above purposes are disclosed in Japanese Patent Application Laid-open No. 2-59356 and in Japanese Patent Application Laid-open No. 2-65086 for example. Such a heating device includes a strip-like heating resistor layer formed on a substrate made of a heat-resistant insulating material such as ceramic for example, and a protective layer formed on the substrate to cover the heating resistor layer. Typically, the protective layer is made of a glass material and arranged to withstand the heat generated at the heating resistor layer while insuring electrical insulation from the exterior and avoiding wear due to contacting with a sheet material fed relative to the heating device.

In such a heating device, it is necessary to insure a sufficient electrical insulation, since a considerably large current is passed through the heating resistor layer to generate Joule heat for heating the sheet material. However, generally, a conventional glass material used for the protective layer has a dielectric strength of only about 14–15 volts per thickness of 1 $\mu$m. Thus, it is necessary to make the thickness of the protective layer considerably large for insuring a sufficient electric insulation. As a result, in the conventional heating device, the heat capacity of the protective layer becomes large, so that the thermal response at the surface of the protective layer is likely to deteriorate (the temperature rises slowly). If, to compensate for this, the amount of the heat generated at the heating resistor is increased, a problem of wasting energy will occur due to low thermal efficiency.

DISCLOSURE OF THE INVENTION

An object of the present invention is to provide a heating device having a rapid thermal response and a high thermal efficiency.

For attaining the above object, according to the present invention, there is provided a heating device for a sheet material comprising a substrate made of a heat-resistant insulating material, a heating resistor layer formed on the substrate, and a protective layer formed on the substrate to cover the heating resistor layer, wherein the protective layer is formed of glass containing 3–30 Wt % of alumina powder as an additive.

With such an arrangement, the addition of alumina powder remarkably increases the dielectric strength per unit thickness of the protective layer in comparison with a glass protective layer containing no additional alumina powder. Thus, since a sufficient dielectric strength can be obtained even with a thin protective layer, thermal transmission from the heating resistor layer to the sheet material can be prevented from being unduly hindered due to the presence of the protective layer.

It is for the purpose of sufficiently enjoying the advantage of the improved dielectric strength that the proportion of added alumina powder is set to be no less than 3 Wt %.

On the other hand, it is for the purpose of preventing the surface of the protective layer from becoming unduly rough that the addition proportion of added alumina powder is set to be no greater than 30 Wt %. If the surface of the protective layer is rough, there will occur inconveniences such as damage caused to the surface of the sheet material in contact with the protective layer, and deterioration of the fixing quality of toner onto a paper sheet in a copying machine and the like. For the same reason, the grain size of the alumina powder is preferably no greater than 5 $\mu$m.

The experiments conducted by the inventor have shown that the proportion of alumina powder added to the glass is advantageously 3–22 Wt % and particularly 10–22 Wt % for increasing remarkably the dielectric strength while providing a smooth surface at the protective layer.

According to a preferred embodiment of the present invention, the heating resistor layer is made in a strip-like form. Further, the substrate is formed with a first terminal electrode at one end as well as a second terminal electrode adjacent to the first terminal electrode. The strip-like heating resistor layer extends from the first terminal electrode toward an opposite end of the substrate and then backward to the second terminal electrode for connection thereto.

Other objects, features and advantages of the present invention will be clearer from the detailed explanation of the embodiment described below with reference to the accompanying drawings.

BEST MODE FOR CARRYING OUT THE INVENTION

The preferred embodiment of the present invention will be described below with reference to the accompanying drawings.

Figure 1:
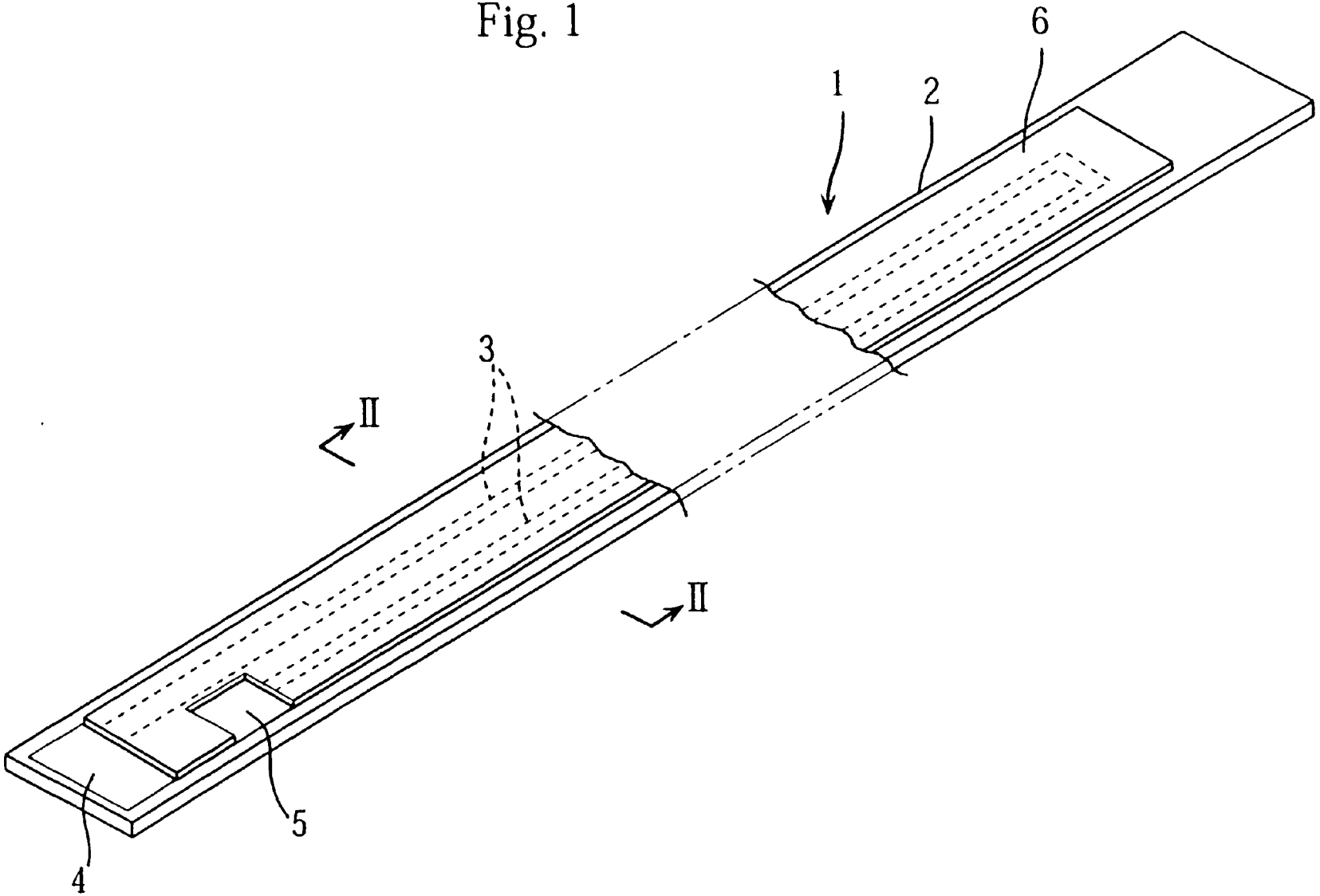
FIG. 1 is a perspective view showing a heating device according to an embodiment of the present invention.
Figure 2:
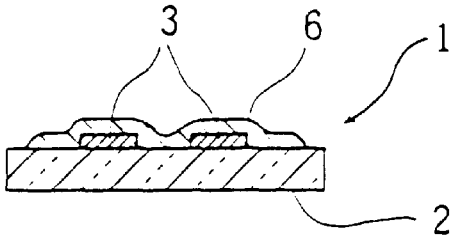
FIG. 2 is an enlarged sectional view taken on lines II—II in FIG. 1.

In FIGS. 1 and 2, reference number 1 generally indicates a heating device according to an embodiment of the present invention as a whole. The heating device 1 includes an elongated strip-like substrate 2 made of a heat-resistant insulating material such as ceramic for example. The substrate 2 has a surface formed with a strip-like heating resistor layer 3 made of an Ag-Pd-Pt material. Further, the surface of the substrate 2 is formed with a first terminal electrode 4 made of a conductive material at one end thereof together with a second terminal electrode 5, adjacent to the first terminal electrode 4, which is also made of a conductive material.

The strip-like heating resistor layer 3 extends from the first terminal electrode 4 toward the other end of the substrate 2, and then extends to the second terminal electrode 5. Further, the surface of the substrate 2 is formed with a glass protective layer 6 for covering the heating resistor layer 3 as a whole. However, both of the first and second terminal electrodes 4, 5 are exposed for electrical connection to an external power source (not shown).

In use, the unillustrated external power source applies a predetermined voltage across two terminal electrodes 4, 5 a current for passing through the strip-like heating resistor layer 3 to generate heat. A sheet material to be heated (not shown) is brought into contact with the glass protective layer 6 for performing a predetermined thermal treatment to the entirety or portions of the sheet material. For instance, when utilizing the heating device 1 as a fixing heater for a copying machine, a copying paper sheet is fed in contact with the glass protective layer 6 so that the toner deposited on the sheet is fixed.

According to the present invention, a glass material for making the protective layer 6 contains $Al_2O_3$ (alumina) powder having grain size of no greater than about 5 $\mu$m. Since alumina has a melting point which is much higher than the softening point of glass, the alumina contained in the protective layer 6 maintains its powder state.

Generally, a glass material used for such a protective layer has a composition of $SiO_2$-PbO-$Al_2O_3$ glass containing additives such as pigment for example, and has a dielectric strength of about 14–15 volts per thickness of 1 $\mu$m. Though a conventional glass material for a protective layer contains alumina ($Al_2O_3$), the alumina in such an instance is contained as a component constituting the glass structure but does not exist in a powder state. Thus, the alumina as a component of glass is incorporated into the glass structure in a molten state when heated to a temperature higher than the melting point of alumina in producing the glass.

Figure 3:
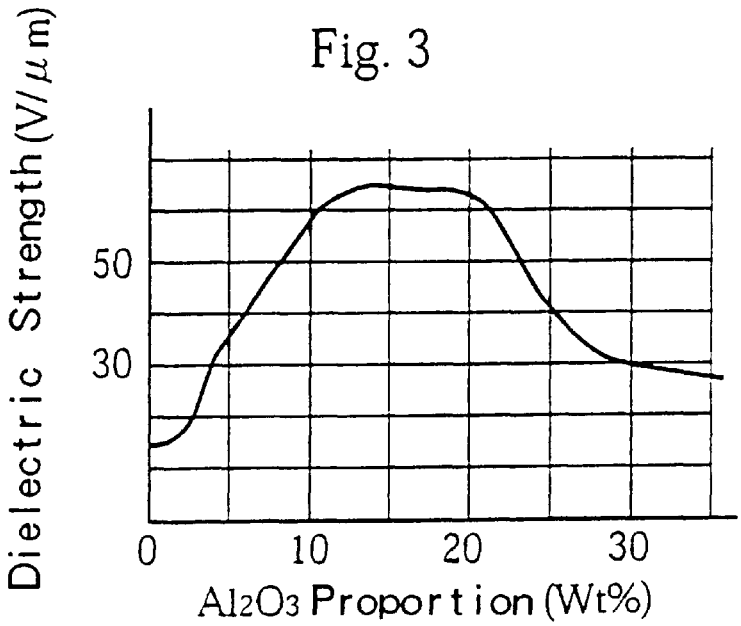
FIG. 3 is a graph showing the relationship between the addition proportion of $Al_2O_3$ and the dielectric strength for a glass protective layer.

In contrast, the inventor has experimentally found that dielectric strength remarkably increases by adding powdered alumina as a filler to such a conventional glass material. Specifically, FIG. 3 is a graph showing the results obtained by an experiment for measuring the relationship between the added alumina proportion and the dielectric strength per thickness of 1 $\mu$m. In this instance, alumina powder having a grain size of no greater than about 5 $\mu$m was added to the glass material having a dielectric strength of about 14–15 volts per thickness of 1 $\mu$m.

The graph shows that the dielectric strength per thickness of 1 $\mu$m can be doubled or increased even more by adding no less than 3 Wt % $Al_2O_3$ powder, as compared to a glass material with no alumina added. Therefore, even when the thickness T of the protective layer 6 made of glass containing alumina powder is no greater than about half that of a protective layer made of glass with no alumina powder addition, the same dielectric strength can be obtained; thereby preventing the thermal transmission from the heating resistor layer 3 to the sheet material from being unduly hindered due to the presence of the protective layer 6.

Figure 4:
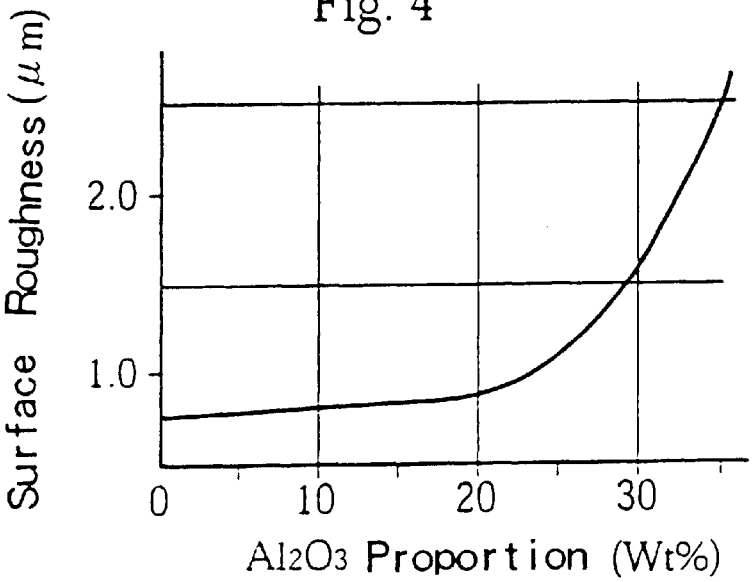
FIG. 4 is a graph showing the relationship between the addition proportion of $Al_2O_3$ and the surface roughness for the glass protective layer.

However, when the proportion of added alumina powder is greater than 30 Wt %, the dielectric strength does not increase much. Further, as shown in FIG. 4, when the proportion of added alumina powder is greater than 30 Wt %, the surface roughness Rz of the surface of the protective layer 6 unduly increases (to 1.7 $\mu$m or more from 0.3 $\mu$m which corresponds to an instance where no alumina powder is added), consequently deteriorating the smoothness of the protective layer 6. As a result, the surface of the sheet material held in contact with the protective layer 6 may suffer damage, and the heating performance may deteriorate due to improper contact with the sheet material (thereby deteriorating fixation of toner onto copying paper in a copying machine). Further, it is also for the purpose of providing a smooth surface of the protective layer 6 that alumina powder having a grain size of no greater than 5 $\mu$m is used.

Thus, the proportion of added alumina powder should be within the range of 3–30 Wt %. Further, as shown in FIGS. 3 and 4, the proportion of added alumina powder is preferably 3–22 Wt % for doubling or even more increasing strength of the protective layer 6 while maintaining the surface roughness of the protective layer 6 below about 1.0 $\mu$m. Particularly, when the proportion of added alumina powder is within a range of 10–22 Wt %, the dielectric strength of the protective layer 6 becomes no less than four times higher than that obtained by a glass material containing no alumina powder, with the surface roughness of the surface of the protective layer 6 maintained below about 1.0 $\mu$m.

Further, the addition of alumina powder to a glass material for making the protective layer 6 is also advantageous for the following reason. Since alumina has a coefficient of thermal conductivity greater than that of silicon dioxide which is the main component of glass, the addition of alumina powder increases the thermal conductivity of the protective layer 6. Thus, the addition of alumina powder serves not only to decrease the thickness of the protective layer 6 but also to facilitate the thermal transmission from the heating resistor layer 3 to the sheet material, thereby improving the performance of the heating device 1.

The glass used for the experiments by which the graphs shown in FIGS. 3 and 4 were made had a composition of 23.94 Wt % $SiO_2$, 56.34 Wt % PbO, 15.49 Wt % $Al_2O_3$ and 4.23 Wt % pigment before alumina powder as a filler was added. After the addition of e.g. 13.9 Wt % alumina powder as a filler (the proportion falls in the above optimum range), the glass composition changed to 20.61 Wt % $SiO_2$, 48.51 Wt % PbO, 13.34 Wt % $Al_2O_3$, 3.64 Wt % pigment and the balance (13.9 Wt %) of alumina powder.

The preferred embodiment of the present invention being thus described, the present invention is not limited to the embodiment.

The composition of the glass for making the protective layer 6 is not limitative, and the present invention is also applicable to glass materials having various compositions which include silicon dioxide ($SiO_2$) as the main component.

What is claimed is:

1. A heating device for a sheet material comprising:

a substrate made of a heat-resistant material;

a heating resistor layer formed on the substrate; and a top-most, non-covered protective surface layer formed of glass containing alumina partly in glass structure and partly in powder state, the alumina powder being contained in a proportion of 3–30 Wt %.

2. The heating device according to claim 1, wherein the alumina powder has a grain size of no greater than 5 $\mu$m.

3. The heating device according to claim 1, wherein the proportion of the alumina powder is 3–22 Wt %.

4. The heating device according to claim 1, wherein the proportion of the alumina powder is 10–22 Wt %.

5. The heating device according to claim 1, wherein the heating resistor layer is made in a strip-like form.

6. The heating device according to claim 5, wherein the substrate is formed with a first terminal electrode at one end as well as a second electrode adjacent to the first terminal electrode, the strip-like heating resistor layer extending from the first terminal electrode toward an opposite end of the substrate and then backward to the second terminal electrode for connection thereto.

* * * * *